US005441274A

United States Patent [19]

Clay

[11] Patent Number: 5,441,274

[45] Date of Patent: Aug. 15, 1995

[54] ADJUSTABLE PUTTER

[76] Inventor: Truman R. Clay, 7631 Coal Creek Pkwy. Southeast, Renton, Wash. 98059

[21] Appl. No.: 145,892

[22] Filed: Oct. 29, 1993

[51] Int. Cl.[6] ..... A63B 69/36; A63B 53/02

[52] U.S. Cl. ..... 273/187.5; 273/168; 273/80.1; 273/163 A

[58] Field of Search ..... 273/167 R, 77 R, 80.1, 273/80 B, 81.4, 81.5, 81.6, 187.4, 187.5, 80.2, 80.4, 168, 171, 172.173, 163 A

[56] References Cited

U.S. PATENT DOCUMENTS

| | | | |
|---|---|---|---|
| 1,133,129 | 3/1915 | Govan | 273/171 |
| 1,488,900 | 4/1924 | Armstrong | 273/163 A |
| 1,610,802 | 12/1926 | McNair | 273/80.1 |
| 2,446,622 | 8/1948 | Turner | 273/81.6 |
| 2,661,952 | 12/1953 | Jackson | 273/168 |
| 3,416,798 | 12/1968 | Pennington | 273/168 |
| 3,684,294 | 8/1972 | Champion | 273/187.4 |
| 3,692,306 | 9/1972 | Glover | 273/172 |
| 3,848,874 | 11/1974 | Elkins | 273/187.5 |
| 4,174,108 | 11/1979 | Reinholz | 273/168 |
| 4,222,567 | 9/1980 | Shabala | 273/163 A |
| 4,506,888 | 3/1985 | Nardozzi | 273/168 |
| 5,058,891 | 10/1991 | Takeuchi | 273/187.5 |

*Primary Examiner*—Sebastiano Passaniti

*Attorney, Agent, or Firm*—Robert W. Beach

[57] ABSTRACT

A golf clubhead includes a lower part with stepped ramps spaced apart and inclined downwardly toward each other engageable by stepped undersurface slopes at the opposite ends of an upper clubhead part carried by the golf club shank, which lower part and upper part can be secured together in different tilted relationships to alter the lie of the golf club. The upper clubhead part has two generally horizontal weight-receiving bores located at opposite sides, respectively, of the longitudinal center of such part and equally spaced from such center, and the clubhead lower part has upright weight-receiving bores located at opposite sides, respectively, of the longitudinal center of such part and equally spaced from such center for receiving weight slugs selectively to alter the weight and balance of the clubhead. The two parts are inserted in a shell having opposite faces forming blades having different lofts. The grip or shaft of the golf club has a club attitude index for reference by the golfer in addressing the golf ball, each index including an elongated element located in a central reference plane of the golf club shaft, and two rows of side elements located on opposite sides, respectively, of the central element, each side element being formed by a curved row of spots flaring from the end closer to the grip butt away from the central element.

22 Claims, 4 Drawing Sheets

Fig. 5
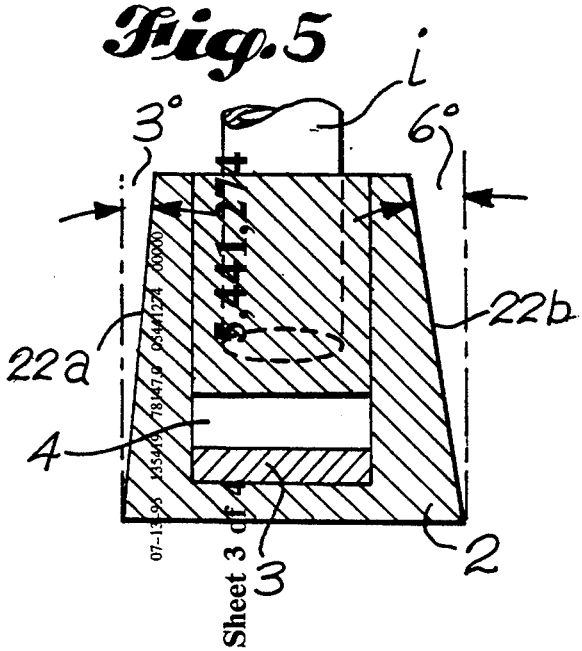
Fig. 12
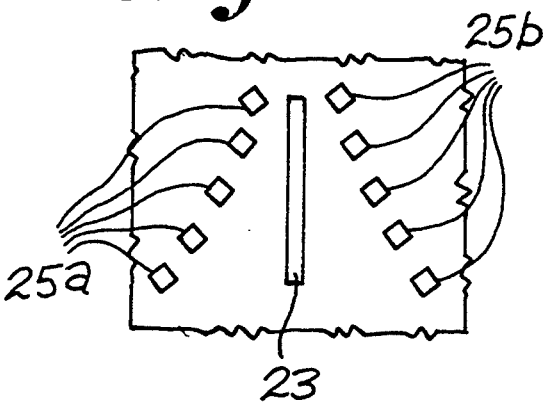
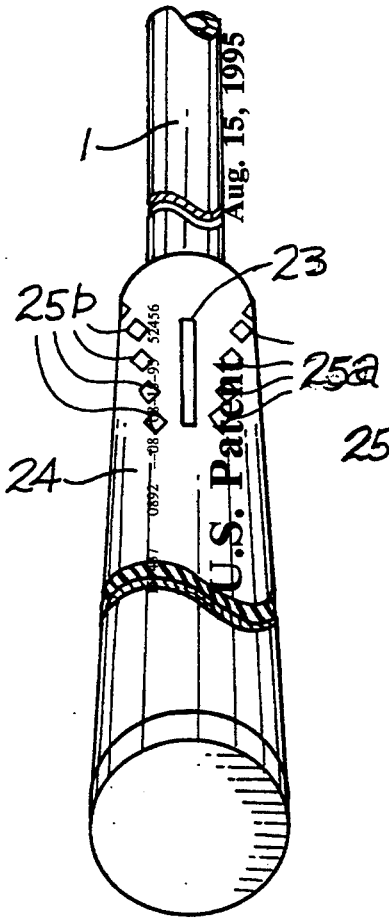
Fig. 6
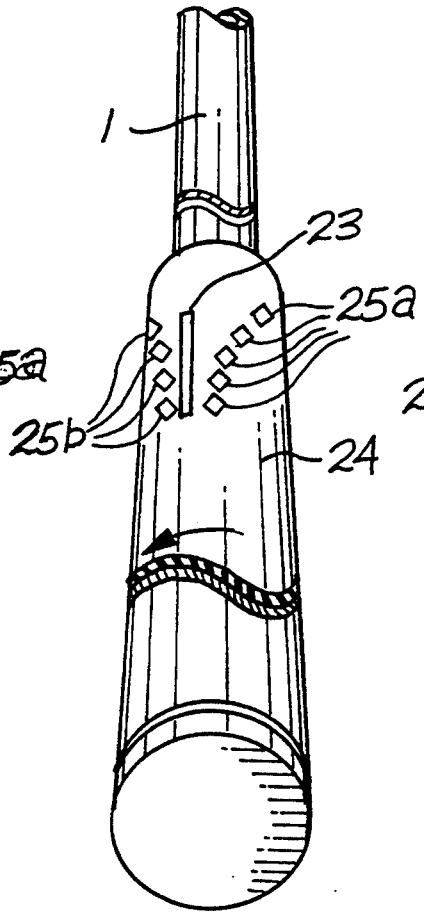
Fig. 7
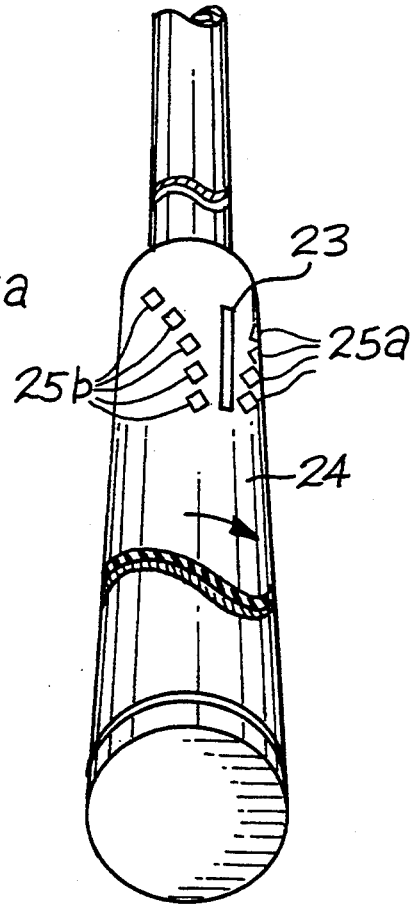
Fig. 8
U.S. Patent Aug. 15, 1995 Sheet 3 of 4 5,441,274

ADJUSTABLE PUTTER

BACKGROUND OF THE INVENTION

FIELD OF THE INVENTION

This invention relates to putters and particularly to putters which have adjustable lie, alternative lofts and selectable head weights.

Definitions

In order to establish the vocabulary used in this specification, the following definitions are quoted from *Webster's Third New International Dictionary:* address 10*a:* to take one's stance and adjust the club preparatory to hitting (a golf ball)

blade 2*g:* the striking surface of a golf club or a hockey stick face 9*b:* the striking surface of the head (as of a hammer or golf club)

golf 1: a game whose object is to sink a golf ball into each of the 9 or 18 successive holes on a golf course by using as few strokes of a golf club as possible and avoiding various natural or artificial hazards or obstacles hook\n 6*b:* a flight of a ball (as in golf, cricket, bowling, baseball) that deviates from a straight course in a direction opposite to the dominant hand of the player projecting it \v 5*a* of a ball: to travel in or be a hook (the ball hooked badly but bounced onto the fairway)

iron 2*k:* one of a series of golf clubs numbered 1 through 9 that have heads of iron or occasionally other metal laid back at a progressively greater angle so as to give progressively greater height and less distance to the flight of the ball lie 5: the angle of the blade or clubhead with the shaft of a hockey stick or golf club loft 5*a* 1: the backward slant of a face of a golf-club head slice \n a flight of a ball (as in golf, tennis, volley ball) that deflects to the right of a right-handed player or to the left of a left-handed player usually as a result of being hit across its center line; also: a ball following such a course \v 3*a*: to put a slice on a stroke or ball b of a ball: to curve in flight in the direction of a slice stance 4*a:* the position of the feet of a golfer or batter preparatory to making a swing Problem The individual characteristics of different golfers are not the same, so that the golfers' natural stance differs and swing planes vary. Also, the right eye of one golfer may be dominant, the left eye of another golfer may be dominant and, in another golfer, neither eye may be dominant, so that different golfers see a target differently, particularly since the golfer is standing sidewise to the direction in which the ball is to be hit. Moreover, some golfers have naturally lighter swings and other golfers have heavier swings.

Also, putting greens differ, some being faster than others, and the performance of a golf ball struck in a particular manner differs between a wet green and a dry green.

All of these factors affect the course and distance that a struck golf ball travels.

A specific example of a problem encountered by golfers is that, if the natural stance and swing of a golfer are consistent and the golfer believes that he is aiming the ball at the desired target, i.e., a hole in a putting green, and yet the ball is consistently deflected to one side or the other of the hole, the present invention provides an expedient for overcoming such ball deflecting without the golfer changing his address of the ball or swing. Thus, if the ball is consistently deflected to the left of the tee, the lie of the golf club can be increased so that the toe of the clubhead is depressed while the angle of the shaft relative to the ground remains constant, which will result in the course of the ball being deflected to the right so that it follows a straight shot to the hole.

Alternatively, if the ball is consistently deflected to the right of the hole, the lie of the golf club can be reduced so that, using the same stroke with the angle of the shaft to the ground unchanged, the toe of the clubhead will be raised, resulting in the ball being deflected to the left to travel a straight shot to the the hole.

Prior Art

Attempts have been made to solve or reduce the foregoing problem as to accuracy and predictability of a golf ball travel by providing custom putters for individual golfers which can be of various types of construction and have a lie, a loft and a head weight considered to be best suited to the particular golfer. In some instances the lie of a golf club is altered by bending the shaft adjacent to the head, but this procedure may injure or weaken the golf club shaft, and it is difficult to make a fine adjustment using this procedure.

SUMMARY OF THE INVENTION

A principal object is to be able to adapt a golf club to the stance and swing plane of a particular golfer by adjusting the lie, choosing the loft, selecting the head weight and establishing the club balance by distribution of the head weight, to tailor the club to the particular golfer.

A further object is to provide for the adjustment of a golf clubhead as to lie, choosing the loft and selecting the head weight and balance easily and accurately.

It is also an object to provide a golf clubhead having adjustability which is rugged and can absorb repeated impacts without damage or alteration of adjustment.

Another object is to provide a golf club attitude index which will indicate to the golfer the relationship of the blade to the ball for reference in addressing the ball.

The foregoing objects can be accomplished by utilizing a golf clubhead composed of a shell housing a two-part insert, one of which parts is attached to the shell and the other of which parts is attached to the shaft and which parts can be secured together in different angularly adjusted relationships, and which parts have cavities for selectively receiving weights enabling the location and amount of weight to be selected for establishing the total weight and balance of the clubhead. The last-mentioned object can be accomplished by providing an index on the lower end of the club grip or on the upper portion of the shaft adjacent to the club grip composed of a center line in a reference plane bisecting the golf club shaft and parallel to the clubhead blade and two rows of spots adjacent to longitudinal horizontal elements of and on opposite sides of such center line, respectively, and flaring equally away from such center line in the direction away from the butt of the grip.

BRIEF DESCRIPTION OF THE DRAWINGS

FIG. 5 is a transverse vertical section through the clubhead taken on line 5—5 of FIG. 3.

FIGS. 6, 7 and 8 are top perspectives of the grip portion of a golf club shaft, parts of the shaft and grip being broken away and the grip being shown in different swiveled positions.

FIG. 12 is a fragmentary enlarged detailed plan of the index portions of a golf club grip such as shown in FIGS. 6, 7 and 8, or of a golf club shaft such as shown in FIGS. 9, 10 and 11.

DETAILED DESCRIPTION

Figure 1:
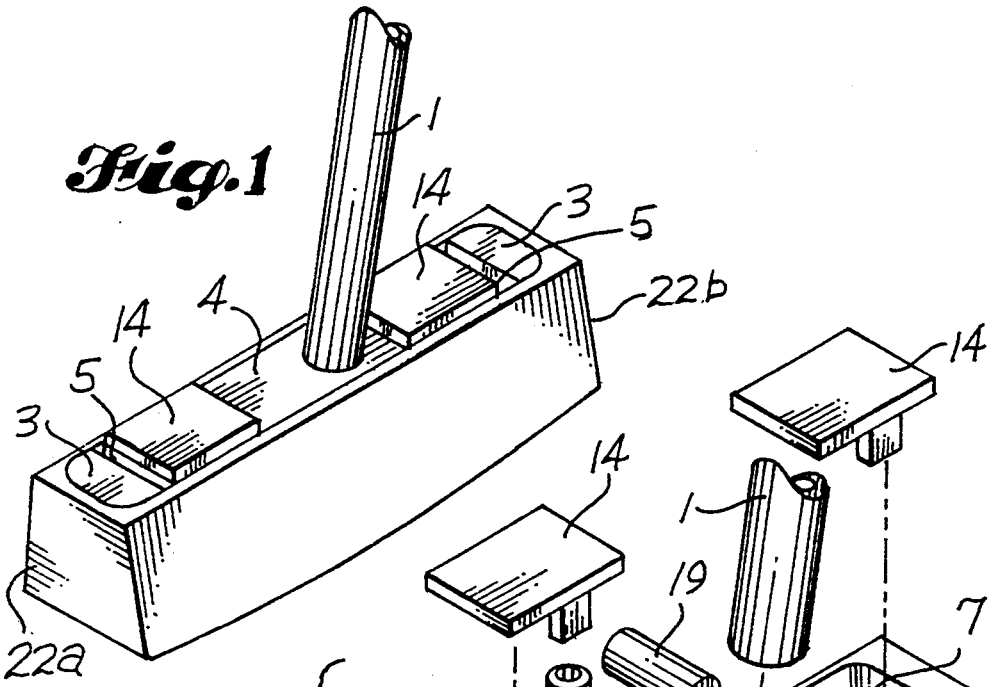
FIG. 1 is a top perspective of a golf clubhead according to the present invention mounted on the lower portion of a golf club shaft, the upper portion of which is broken away.
Figure 2:
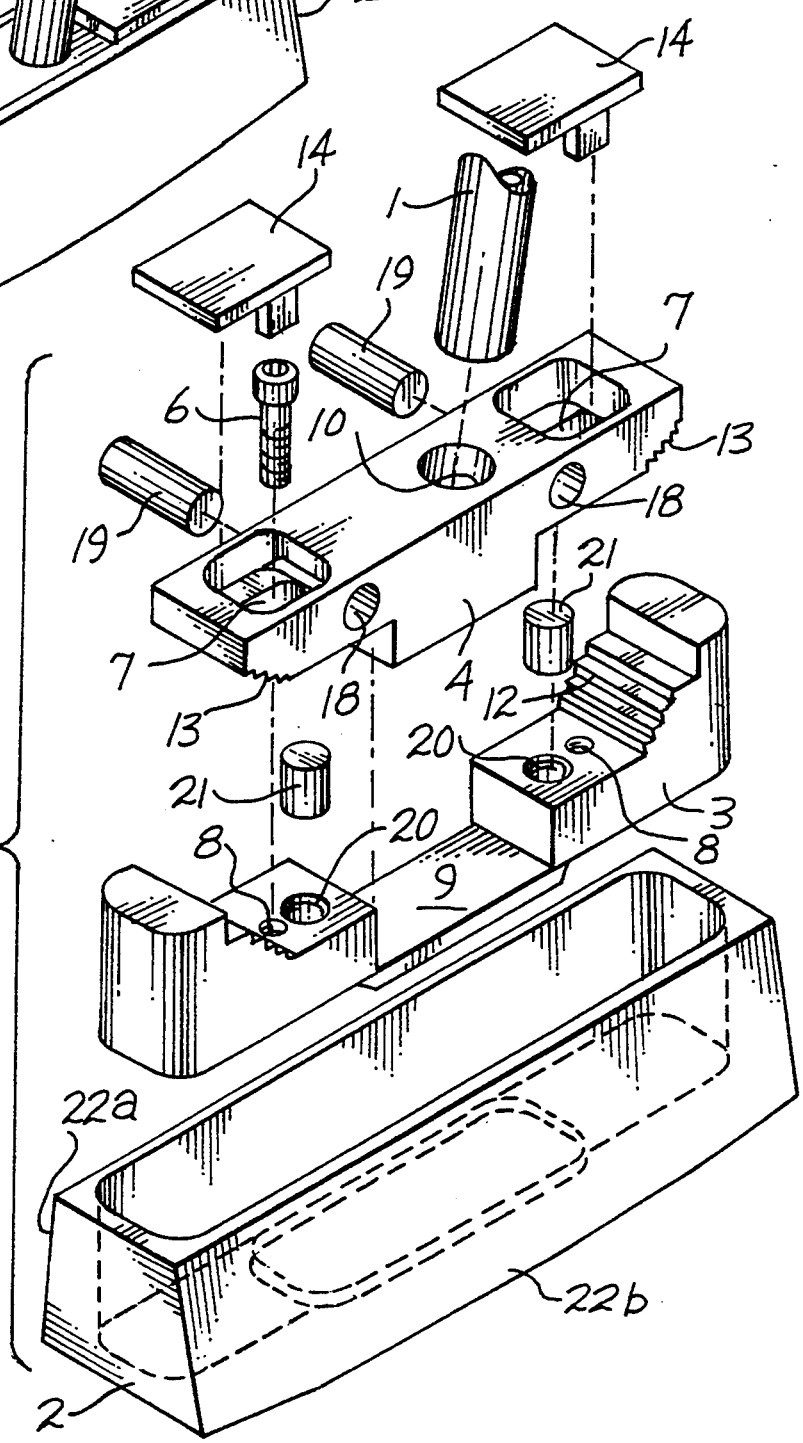
FIG. 2 is a top perspective of the golf clubhead shown in FIG. 1 but with parts in exploded relationship.

The present invention provides a golf clubhead, parts of which can be relatively angularly adjusted to alter the golf club lie, with alternate lofts and which clubhead can be weighted to various degrees and in different locations to tailor the golf club to the need of an individual golfer. Such lie adjustment, loft selection and weight amount and distribution can be accomplished by a golf clubhead constructed according to the present invention without deforming any parts of the golf club and without any modification to the exterior of the clubhead.

The clubhead according to the present invention carried by the golf club shaft 1 includes a shell 2 which may be of any desired design but preferably is of simple configuration of generally rectangular transverse cross section as shown in FIG. 5.

A key feature of the present invention is the provision of a two-part insert housed within the shell 2 and including a lower part 3 of generally trough shape and an upper part 4 of generally T shape which are symmetrical about their transverse central planes. The bottom of the upper part 4 is generally complemental to the top of the lower part 3. The upper insert part 4 fits into the upwardly-opening cavity of the lower insert part 3 but is shorter than the length of the upper portion of the cavity in the lower insert part to provide spaces 5 at the opposite ends of the insert when the upper insert part 4 is fitted into the lower insert part 3.

The upper insert part 4 is fastened securely in the lower insert part 5 by a tap bolt 6 passing through an aperture 7 in the upper insert part 4, which aperture is elongated lengthwise of the insert. The bolt can then be screwed into a tapped aperture 8 in the lower insert part 3 to fasten the two insert parts together securely. The tap bolt 6 is offset from the longitudinal center of the inserts, and apertures 7 and 8 can be provided in corresponding positions at opposite sides of the centers of the insert parts so that, if desired, two tap bolts can be used to secure the insert parts together, but usually the use of a single tap bolt is sufficient.

Preferably the lower portion of the lower insert part 3 has a plate-like generally horizontal downward projection 9 which fits into an interior upwardly-opening cavity in the shell 2. The lower insert part can be secured permanently within the shell 2 by bonding such plate-like portion 9 and the opposite end portions of the lower insert part to the complemental surfaces of the interior of the shell as shown in FIGS. 3 and 4.

The upper insert part 4 is permanently secured to the lower end portion of the golf club shaft 1 by fitting such club portion into an upwardly-opening cavity 10 in the upper side of the upper insert part. Such cavity 10 is of cylindrical shape and preferably is located generally centrally of the length of the upper insert part 3, although it could be located closer to the heel of the clubhead, if desired. The axis of such cavity is inclined so that, when the upper insert part 4 is centered with respect to the lower insert part 3 as shown in FIG. 3, the center line 11 of the shaft 1 will intersect the longitudinal center of the shell sole when the upper insert part 4 is centered with respect to the lower insert part 3 as shown in FIG. 3, unless the shaft is located farther toward the heel of the clubhead.

Figure 3:
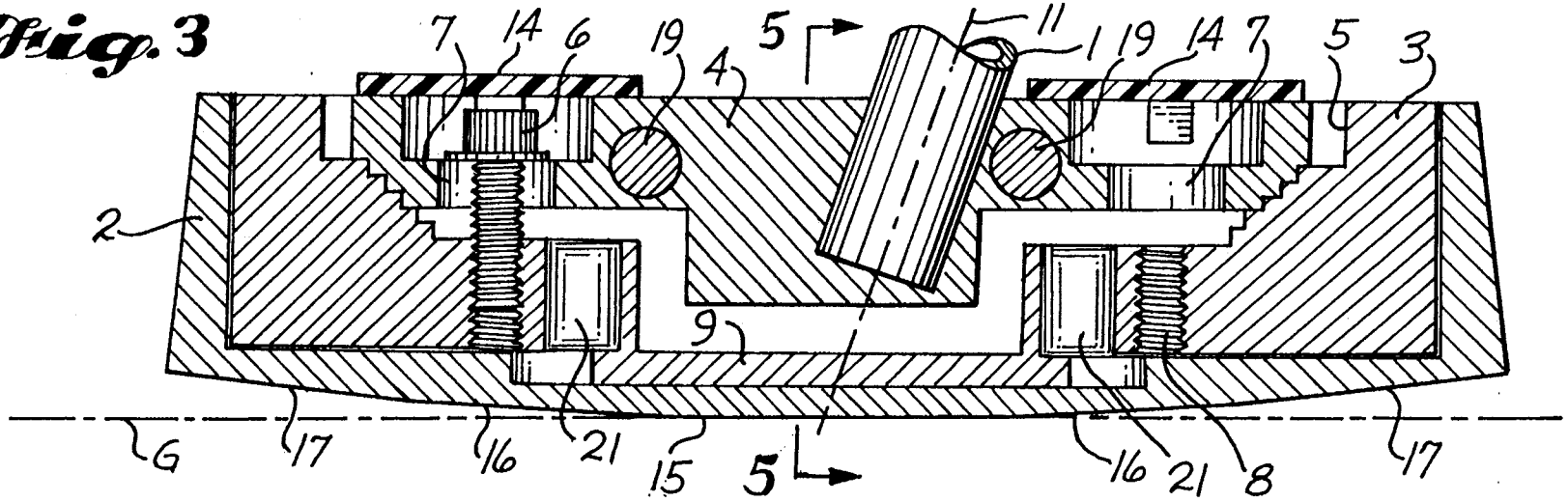
FIG. 3 is a central vertical longitudinal section through the clubhead with the upper portion of the golf club shaft broken away.
Figure 4:
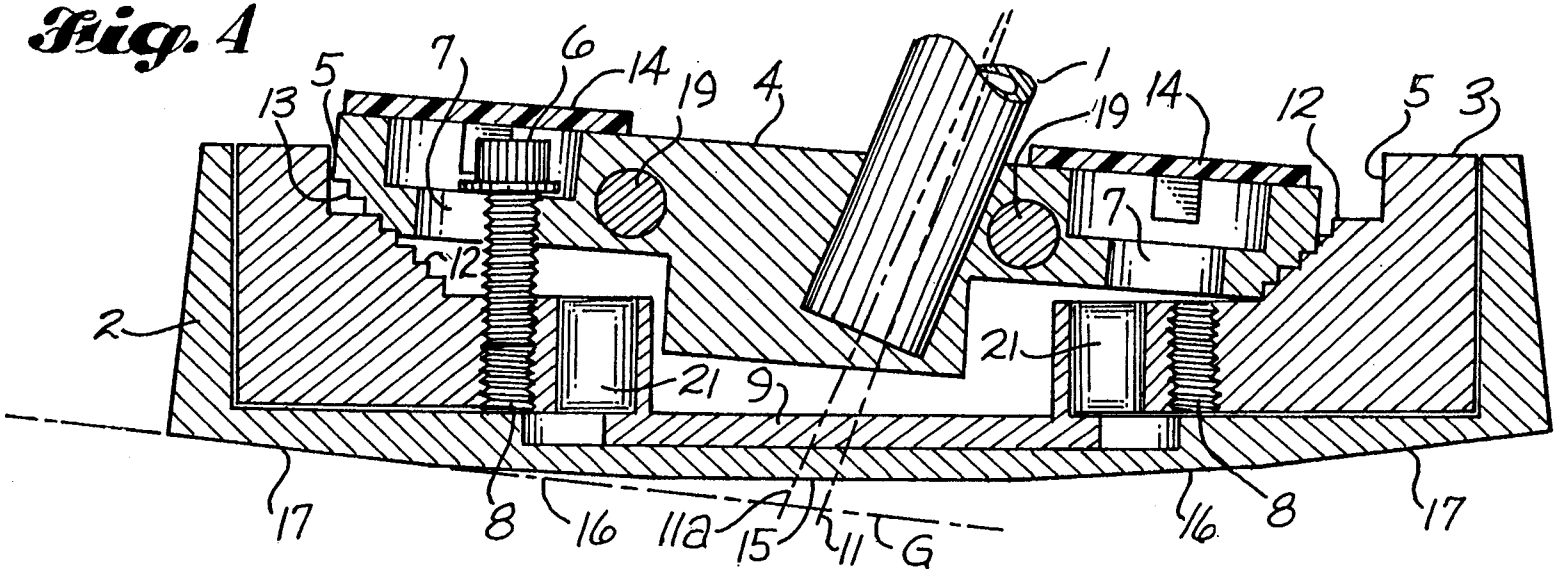
FIG. 4 is a similar view showing parts in a different relationship to change the lie of the golf club.

When the upper insert part 4 is centered with respect to the lower insert part 3 as shown in FIG. 3, the center line 11 of the shaft is preferably at an angle of 72 degrees to the sole as shown in FIG. 3, which has been determined by the golfing industry to be standard for putters. A mashie or No. 5 iron has a standard lie of 59 degrees, and a driver has a standard lie of 55 degrees. Alternatively the club may have a lie other than standard.

The golf club of the present invention enables a golfer to alter the lie of a golf club so that, without changing the angle of the shaft to the ground, the lie can be decreased so that the toe will be raised to deflect the ball to the left, or the lie can be increased to depress the clubhead toe for deflecting the ball to the right to correct a deflection resulting from the usual stroke of a golfer so that the ball will execute a straight shot to the hole. The construction of the present invention provides for the upper insert part 4 to be secured to the lower insert part 3 in different angularly adjusted or relatively tilted relationships such as where the center line of the shaft is tilted from the position 11 shown in FIG. 3 to the position 11a shown in FIG. 4, in which the lie of the golf club is decreased from 72 degrees to 66 degrees.

To enable the upper insert part 4 to be secured to the lower insert part 3 firmly and reliably in such adjusted position, for example, the lower insert part has in its cavity adjacent to opposite ends of the insert part, respectively, oppositely inclined stepped ramps 12. The upper insert 4 has at its opposite ends downwardly and inwardly inclined slopes 13 in overhangs 13 which are stepped complementally to the steps of ramps 12. When the two parts of the insert are in untilted position as shown in FIG. 3, the steps of the overhang slopes 13 engage the steps of the ramps 12 in the lower insert part 3 symmetrically as shown in FIG. 3. To increase the lie, the upper insert part 4 is shifted longitudinally relative to the lower insert part 3 in the direction opposite that shown in FIG. 4.

If the insert parts are shifted relatively one step, the incremental change in lie may be one degree, two degrees or three degrees. The size of the steps of the ramps in the lower insert part 3 and the size of the steps in the slopes 13 of the upper insert part shown in the drawings alter the lie three degrees when the upper insert part is shifted one step relatively to the lower insert part. In FIG. 4, the upper insert part 4 has been shifted to the left relative to the lower insert part 3, two steps resulting in relative angular change or relative tilt of the parts of six degrees.

By shifting the upper insert part 4 lengthwise relative to the lower insert part 3 to the left as seen in FIG. 3, such as into the relationship shown in FIG. 4, the lie will be decreased, such as from 72 degrees to 66 degrees. If, on the other hand, the upper insert part 4 is shifted to the right as seen in FIG. 3 relative to the lower insert part 3, the lie will be increased from 72 degrees to 75 degrees if the insert parts are shifted one step, or the lie will be increased to 76 degrees if the upper insert part is shifted relative to the lower insert part two steps.

In order to enable the upper insert part 4 to be shifted lengthwise relative to the lower insert part 3 to adjust the lie of the golf club, the tap bolt 6 must be loosened sufficiently to free the insert parts for such relative movement. During such movement, the aperture or slot 7 which is elongated lengthwise of the upper insert part 4 will shift with the upper insert part relative to the cap bolt 6. When the upper insert part 4 has been adjusted lengthwise into the desired position relative to the lower insert part 3, the tap bolt or tap bolts 6 can be tightened to hold the insert parts securely in such adjusted position. The cavity in the upper side of the upper insert part 4 in which the head of the tap bolt is received can then be closed by a cover 14 having spring fingers that will frictionally engage the sides of such recess.

As shown in FIGS. 3 and 4, the sole of the clubhead shell 2 is preferably formed as a series of chordal flats from one end to the other. Thus the central portion of the shell sole is formed as a flat 15, and the adjoining portions of the sole at opposite sides of the flat 15 are formed as flats 16 arranged at a dihedral angle to the flat 15 equal to 180 degrees minus the increment of change between adjacent steps of the ramps 12 of the lower insert part 3 and of the slopes 13 of the upper insert part 4. Thus in the clubhead shown in FIGS. 3 and 4, the dihedral angle between the central flat 15 and the adjoining flats 16 will be 177 degrees.

At the sides of flats 16 opposite central flat 15, the sole of the clubhead shell 2 is formed with additional chordal flats 17. The dihedral angles between the flats 17 and the flats 16 should be the same as the dihedral angles between the flats 16 and the central flat 15, namely, 177 degrees. In both FIGS. 3 and 4, the central flat 15 is in engagement with the ground, represented by the line G.

In order to select the desired amount of weight for the clubhead and the weight distribution to establish the desired balance of the clubhead, provision is made for housing multiple weights in the clubhead inserts at different locations in such inserts. The desired weight and weight distribution of the clubhead can thus be established by installing the desired number of weights in the clubhead and locating them appropriately for establishing the desired balance of the clubhead.

For weight selection and distribution purposes, the upper insert part 4 has two horizontal crossbores 18 located in positions offset equal distances from the longitudinal center of such insert part for receiving weight slugs 19. If only one of such slugs is placed in a bore 18 while the other bore is empty, the balance of the clubhead will be altered as well as the overall weight of the clubhead being decreased from the weight of the clubhead if slugs were located in both of the bores 18.

Additional opportunities for altering the weight and weight distribution of the clubhead are afforded by providing bores 20 in the lower insert part 3 at locations offset equal distances from the longitudinal center of such insert. Weight slugs 21 can be inserted in such bores 20, respectively. Again, a slug can be inserted in either of the bores 20 and the other bore can be left empty if such weight distribution will effect a desired weight or balance for the clubhead.

In addition to being able to adjust the club lie to alter the angle of the clubhead to the ground for a given angle of the shaft to the ground and the clubhead weight and balance to suit a particular golfer, selection of the clubhead loft is afforded by providing a double-bladed clubhead by making the shell 2 generally symmetrical and having blades or faces of different lofts on its opposite sides. FIG. 5, which is a vertical transverse section through the clubhead, shows the blade **22*a* formed by one face of the shell as having a slope or slant of 87 degrees, i.e., three degrees from vertical, and the blade 22*b* formed by the opposite face of the shell 2 as having a slope or slant of 84 degrees, i.e., six degrees from vertical. The face of the clubhead shell 2 being utilized as the blade 22*a* or 22*b* can be selected alternately to change the loft of the golf club by reversing the clubhead side-for-side relative to the shaft. This selection is effected by reversing the upper insert part 4 end-for-end relative to the lower insert part 3**.

The slants or slopes of the opposite faces of the shell 2 preferably differ by two or three degrees. Thus, while the slants of the two shell faces shown in FIG. 5 differ by 3 three degrees, they could differ by 2 degrees or 2½ degrees. Preferably the departure of one face from vertical is half as much as the departure of the other face. Thus the two slants could be 2 degrees and 4 degrees from vertical or 2½ and 5 degrees from vertical or 3 degrees and 6 degrees from vertical. Such different alternate slants can be embodied in replacement shells having different lofts.

It will be appreciated that the lie of the club, the loft of the club and the weight and balance of the club are independent variables, any one of such characteristics being capable of change without changing the other characteristics, or any combination of such characteristics can be changed.

Selecting independently a particular lie, loft, head weight and balance combination for a golf club is much more effective if the club can be oriented consistently. To facilitate such orientation, particulary as to the rolled position of the golf club shaft to establish the desired relationship between the blade and golf ball, an attitude roll index is provided for reference by the golfer in addressing the ball. Such index consists of a central element shown as a center line 23 on the curved side of the generally cylindrical golf club grip 24 in FIGS. 6, 7 and 8 and on the portion of the curved side of the generally cylindrical shaft 1 adjacent to the grip 24 in FIGS. 9, 10 and 11. In both instances, the center line 23 is disposed in the reference plane which bisects the golf club shaft longitudinally, which is generally parallel to the blade and which is perpendicular to the flats 15, 16 and 17 of the clubhead sole. If the center line 23 is centered in such reference plane, therefore, it will be assured that the blade will strike the ball to propel it in a plane perpendicular to the reference plane.

In addition to the center line 23, the club attitude roll index includes two rows of spots **25*a* and 25*b* at opposite sides of the center line, respectively, which respectively diverge from the central reference plane of the shaft. These rows of spots are adjacent to the center line, and each row is curved to flare from the end closer to the grip butt toward the club head. As shown in FIGS. 6 and 12, the rows flare symmetrically with reference to the center line. These spots are located on the curved side of the generally cylindrical golf club grip or shaft on which the line 23 is centered. Also the sports should be of angular shape, preferably square or diamond shape, with one of their axes joining opposite apexes extending parallel to the center line central element 23**. Adjacent spots in the rows should be of different colors to enable the rolled displacement of the side rows of spots to be detected more easily. To enhance visibility, the colors should be bright, such as red, yellow or light green or blue, and preferably fluorescent.

Figures 9, 10, 11:
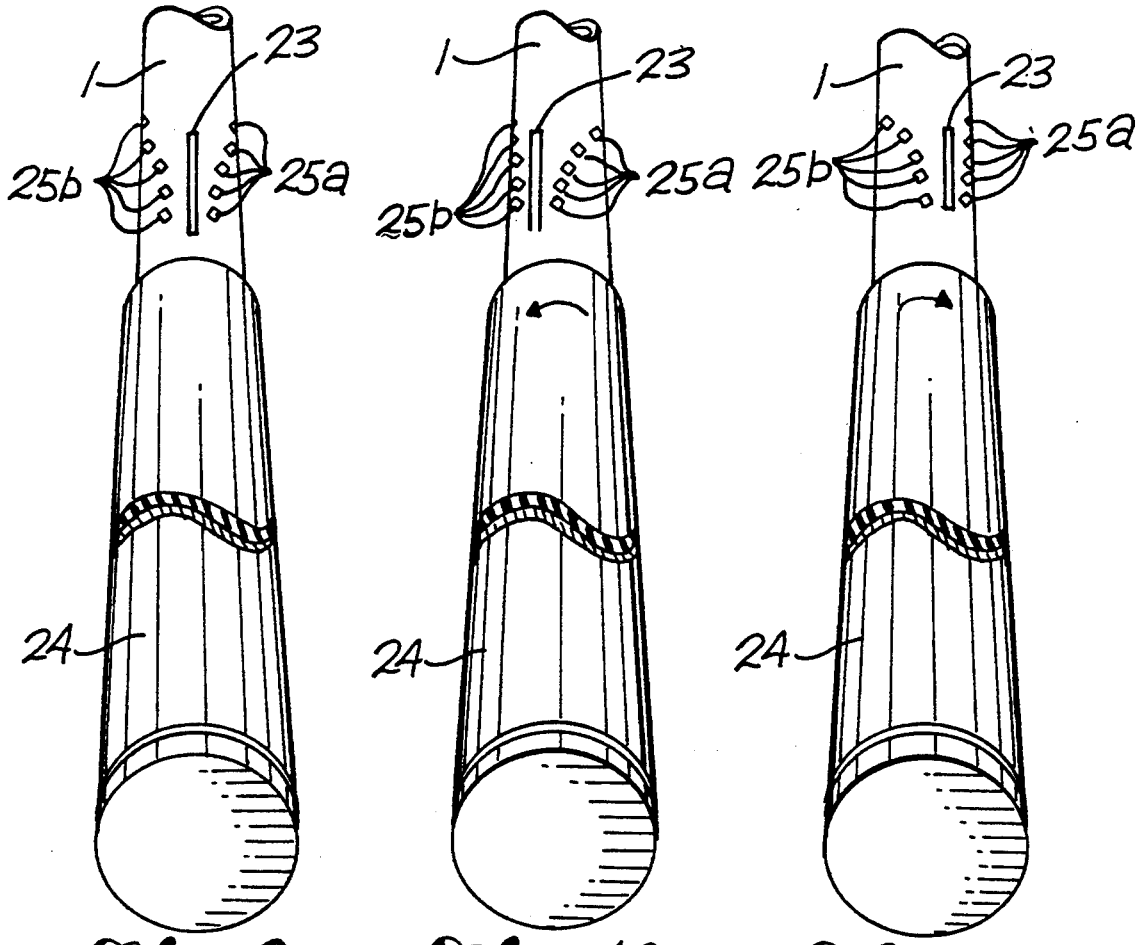
FIGS. 9, 10 and 11 are top perspectives of the grip and the adjacent portion of the shaft showing another embodiment of the invention, parts of the grip and shaft being broken away and the grip and shaft being shown in different swiveled positions.

The curvature of each row of spots is sufficiently sharp so that, as the golf club shaft is rolled from the position shown in FIGS. 6 and 9 to the position shown in FIGS. 7 and 10 or to the position shown in FIGS. 8 and 11, the end of a spot row nearer the club head will begin to disappear, as shown in FIGS. 7, 8, 10 and 11. If the side rows of spots 25*a* and 25*b* appear symmetrical to the golfer, as shown in FIGS. 6, 9 and 12, he will be assured that the blade of the golf clubhead is disposed relative to the golf ball so that the elements of the blade which are parallel to the sole central flat 15 are perpendicular to the plane in which the ball will be propelled by being struck by the clubhead blade. By referring to such club attitude roll index the golfer can avoid inadvertently hooking or slicing the ball.

I claim:

1. In a golf club, the lie of which can be adjusted, a clubhead comprising an elongated lower part having spaced lengthwise thereof two ramps inclined oppositely downward toward each other, and an elongated upper part having on the underside thereof and spaced lengthwise thereof two slopes inclined downwardly toward each other and complemental to said ramps in said lower part, said upper part being tiltable relative to said lower part by shifting said upper part lengthwise relative to said lower part to alter the engagement of said slopes of said upper part with said ramps of said lower part.

2. In the golf club defined in claim 1, the ramps of the clubhead lower part being stepped and the slopes of the clubhead upper part having steps complementary to the steps of the clubhead lower part ramps.

3. In the golf club defined in claim 1, the clubhead upper part having opposite ends which opposite ends are formed as overhangs and the slopes being on the undersides of the overhangs.

4. In the golf club defined in claim 1, the clubhead further including a shell and an insert in said shell including the clubhead lower part and the clubhead upper part.

5. In the golf club defined in claim 4, the shell having opposite sides which opposite sides are formed as blades and said blades having different lofts.

6. In the golf club defined in claim 1, one of the parts having in it weight-receiving bores.

7. In the golf club defined in claim 6, the weight-receiving bores being in the clubhead upper part and having axes generally parallel to the slopes on the underside of the clubhead upper part and extending transversely of the length of the clubhead upper part.

8. In the clubhead defined in claim 6, the weight-receiving bores being in the clubhead lower part and being arranged with their axes upright.

9. In the golf club defined in claim 6, the clubhead upper part having two weight-receiving bores which have axes generally parallel to the slopes on the underside of the clubhead upper part and extending transversely of the length of the clubhead upper part, and the clubhead lower part having two weight-receiving bores arranged with their axes upright.

10. In the golf club defined in claim 1, the golf club further including a shaft member and a grip member carried by the end portion of the shaft member remote from the clubhead, one of said members having a club attitude roll index including an elongated central element disposed in a central plane of the golf club shaft member, and two elongated side elements adjacent to opposite sides of said central element, respectively, and flaring oppositely, respectively, away from said central element, said central element and said side elements forming an index indicating the swiveled attitude of the shaft member.

11. In the golf club defined in claim 10, the side elements flaring away from the central element in the same direction.

12. In the golf club defined in claim 10, the elongated side elements being rows of spots.

13. In the golf club defined in claim 12, adjacent spots in the side elements being of different colors.

14. The golf club defined in claim 1, the clubhead upper part and the clubhead lower part being relatively shiftable to alter their relationship for changing the loft of the golf club.

15. In the golf club defined in claim 5, the clubhead lower part and the clubhead upper part being fittable in the shell in two different relationships alternatively, in one of such relationships the clubhead lower part being reversed end-for-end with respect to the clubhead upper part in the other relationship.

16. In a golf club including a generally cylindrical shaft member, a clubhead carried by the shaft member and having a blade, and a generally cylindrical grip member carried by the end portion of the shaft member remote from the clubhead, the improvement comprising one of the members having a club attitude roll index located on the curved side of such generally cylindrical member and including a central element disposed in a central plane of the golf club shaft member, which plane is generally parallel to the clubhead blade, and two elongated side elements at opposite sides of said central element, respectively, and respectively diverging from said central plane, said central element and said side elements forming a roll index whereby the relationship of said side elements to said central element observed by the user indicates the roll attitude of the shaft member and the attitude of the clubhead blade.

17. In the golf club defined in claim 16, in which the side elements are elongated rows of spots extending lengthwise along the length of the member on which they are located.

18. In the golf club defined in claim 17, the spots being of rectangular shape and arranged with opposite sides extending generally parallel to the length of the row of spots.

19. In the golf club defined in claim 17, in which adjacent spots in the side elements are of different colors.

20. In the golf club defined in claim 17, the side rows of spots being curved to flare symmetrically from the central element.

21. In the golf club defined in claim 16, the central element being elongated and having its length extending lengthwise of the member on which it is located and the side elements having their lengths extending lengthwise of the member on which they are located and flaring away from the central element in the same direction lengthwise of the central element.

22. In the golf club defined in claim 21, the shaft member having a butt located farthest from the clubhead, and the side elements flaring relative to the central element away from the butt of the shaft member.

* * * * *